US005769209A

United States Patent [19]

Massey, III

[11] Patent Number: 5,769,209

[45] Date of Patent: Jun. 23, 1998

[54] HANDLE FOR ELECTRICAL TOGGLE SWITCH ON A TRUCK DASH

[75] Inventor: William G. Massey, III, Portland, Oreg.

[73] Assignee: Freightliner Corporation, Portland, Oreg.

[21] Appl. No.: 675,341

[22] Filed: Jul. 1, 1996

[51] Int. Cl.[6] ..... H01H 3/00

[52] U.S. Cl. ..... 200/339; 200/330; 200/331

[58] Field of Search ..... 200/339, 553, 200/554, 555, 556, 557, 558, 559, 560, 561, 562, 563, 302.3, 332

[56] References Cited

U.S. PATENT DOCUMENTS

| | | |
|---|---|---|
| 1,940,716 | 12/1933 | Hubbel, Jr. . |
| 2,334,901 | 11/1943 | Bullerjahn . |
| 2,440,943 | 5/1948 | Gonsett et al. . |
| 2,868,920 | 1/1959 | Mumford et al. . |
| 3,604,868 | 9/1971 | Batcheller . |
| 3,614,346 | 10/1971 | Gudaltis . |
| 3,641,291 | 2/1972 | Carling . |
| 3,732,390 | 5/1973 | Novak . |
| 3,988,556 | 10/1976 | Hyodo . |
| 3,988,558 | 10/1976 | Josemans et al. . |
| 4,051,336 | 9/1977 | Miller . |
| 4,121,071 | 10/1978 | Campbell et al. . |
| 4,127,754 | 11/1978 | Josemans et al. . |
| 4,127,756 | 11/1978 | Peterson et al. . |
| 4,148,002 | 4/1979 | Krasser . |
| 4,319,107 | 3/1982 | Haskins . |
| 4,332,991 | 6/1982 | Nordstrom . |
| 4,620,077 | 10/1986 | Zdanys, Jr. et al. . |
| 5,124,513 | 6/1992 | Blair ..... 200/331 |

*Primary Examiner*—David J. Walczak
*Attorney, Agent, or Firm*—Klarquist Sparkman Campbell Leigh & Whinston, LLP

[57] ABSTRACT

A toggle switch handle for a toggle switch mounted to the dash of a truck consists in substantial part essentially of a resilient bendable material. The switch is generally spatulate in shape with a base, a distal end, rounded side edges and recessed or concave major opposed surfaces. The handle is elongated with a longitudinal axis. The handle has a stiffness in bending in response to a force applied at the distal end of the handle and in a direction perpendicular to longitudinal axis from twenty-five pounds to thirty pounds per inch at seventy-five degrees Fahrenheit and most preferably twenty-eight pounds per inch. The handle may be of an elastomeric material of a durometer of from 85 to 95, and most preferably about 90, on the Shore A scale measured at seventy-three degrees Fahrenheit. The handle is coupled to switch components by a lever. The extent to which the lever projects into the base of the handle is limited so that the lever has a minimal impact on the bendability of the toggle switch handle. During impact, such as may arise during a collision, the toggle switch handle bends to absorb shock arising from impact against the handle during the collision.

15 Claims, 4 Drawing Sheets

20
34

38
$d_1$
$d_3$
36
80
70
22
32
26
24
14
$d_2$
$d_4$
14
11
64
64
12
60
62
50
82
88
84
52

HANDLE FOR ELECTRICAL TOGGLE SWITCH ON A TRUCK DASH

BACKGROUND OF THE INVENTION

The present invention relates to trucks with toggle with actuated electrical controls and more specifically to handles or toggles for such switches.

A toggle switch is an easy to operate control for truck electrical devices. For example, a driver may reach and operate a toggle switch without taking his or her eyes off the road as it is easy to operate such switches by feel.

It is desirable to place toggle switches on the dash of a truck near other instruments and instrument controls for easy access. However, by their very nature toggle switches have handles which project outwardly from the dash. Consequently, during a collision or other unexpected impact, a driver may be thrown toward the truck dash and against the toggle switches. Consequently, projecting switches may contribute to impact injuries to a driver or other individual in the vehicle.

Therefore, a need exists for improved toggle switch handles which are easy to operate and which reduce the risk of injury in the event they are inadvertently impacted.

SUMMARY OF THE INVENTION

The present invention relates to a truck dash having at least one electrical toggle switch with a handle in accordance with the present invention, to electrical toggle switches with such handles, and to toggle switch handles.

In accordance with one aspect of the present invention, a toggle switch handle has a base positioned adjacent to the front surface of a truck dash and a distal end spaced from the base. The handle is comprised of a resilient flexible material. In accordance with one aspect of the invention, the handle has a stiffness in bending (springback) in response to a force applied at the distal end of the handle and in a direction perpendicular to the longitudinal axis of the handle from 25 pounds to 30 pounds per inch at seventy-five degrees Fahrenheit. In a specifically preferred form, the handle has a stiffness in bending of 28 pounds per inch at seventy-five degrees Fahrenheit and is of an elastomeric material, such as Santoprene thermoplastic elastomer material.

As a further aspect of the present invention, the handle may be of a spatulate shape with opposed major surfaces and first and second side edges. The major surfaces have recessed regions proximate to the distal end of the handle to facilitate actuation of the handle by a vehicle operator and to facilitate bending of the handle in response to impact. In addition, the handle may have a distal end and first and second side edges which are rounded.

As yet another aspect of the present invention, the handle is coupled to a lever or actuator which forms a portion of the electric switch actuated by the handle. The lever extends into the handle no more than one-third, and most preferably no more than one-fourth, of the distance which the handle projects from the surface of the dash. As a result, the lever has minimal impact on bending of the handle on impact.

As a specific preferred material, the handle may consist essentially of an elastomeric material of a durometer from 85 to 95 on the Shore A scale measured at seventy-three degrees Fahrenheit with a durometer of 90 on the Shore A scale being a specific example of a most preferred material.

It is accordingly an object of the present invention to provide a handle for a toggle switch for a truck dash which is flexible so as to absorb shock upon impact by a driver or passenger of the truck.

Yet another object of the present invention is to provide a handle of an improved configuration for a toggle switch mounted to a truck dash.

The present invention is related to the above features and advantages individually as well as collectively. These and other features and advantages and objects will become apparent with reference to the foregoing description and drawings.

DETAILED DESCRIPTION OF THE PREFERRED EMBODIMENTS

Figure 1:
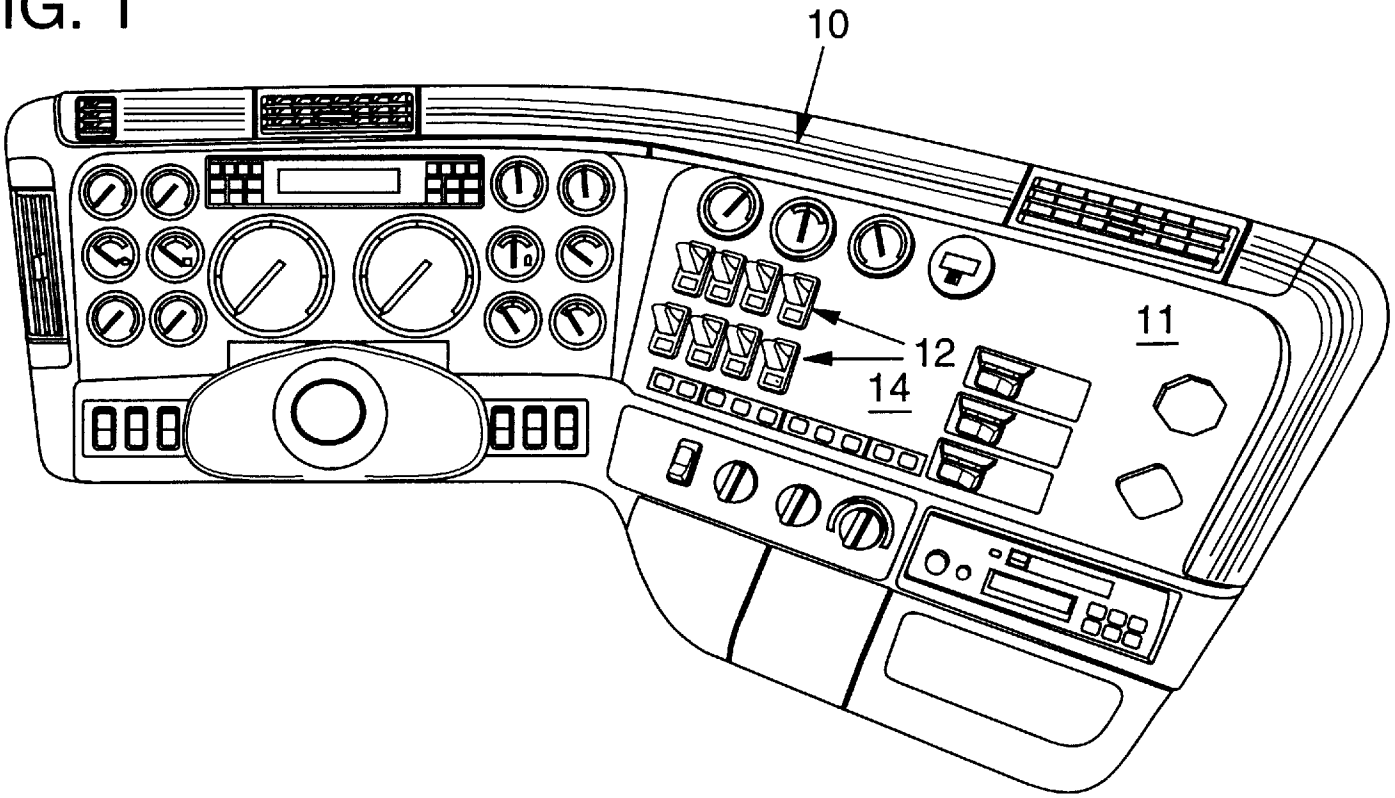
FIG. 1 is a perspective view of a truck dash including toggle switches with handles in accordance with the present invention.

With reference to FIG. 1, a truck 10 is shown having a dash 11 with a number of gauges, switches and other controls. The truck 10 includes at least one, and in this case eight, toggle switches, two of which are indicated by the number 12. The toggle switches 12 are mounted to the front surface 14 of the dash 11.

Figure 2:
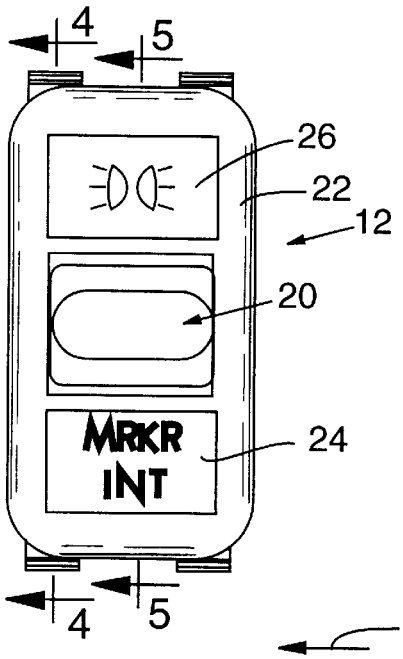
FIG. 2 is a plan view of a toggle switch with a toggle switch handle in accordance with the present invention.

As shown in FIG. 2, the toggle switch 12 includes a central paddle or handle 20 for actuating the switch. The toggle switch has a deck or platform 22 with the handle 20 projecting outwardly from the deck and from the dash surface 14 toward the interior of the truck cab. The switch 12, in this illustrated embodiment, includes indicia panels 24, 26, which may be illuminated from below. The indicia on panels 24, 26 indicate the function controlled by the particular switch. Panel 26 includes an icon to indicate that the truck marker lights are on. Indicia 24 indicates the switch handle position for interrupting the marker lights, for example to flash them as a truck is being operated. Of course, other indicia may used to denote the electrical devices controlled by the position of the handle 20 of particular toggle switches 12.

Figure 3:
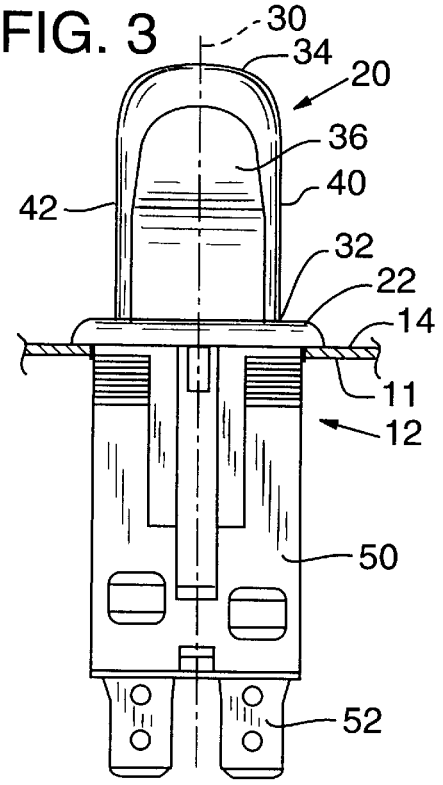
FIG. 3 is an end elevation view of a toggle switch with a handle in accordance with the present invention.

As can be seen from FIG. 3, the handle 20 is elongated and has a longitudinal axis indicated at 30. The handle 20 projects outwardly from the front surface 14 of the truck dash 11. The handle has a base 32 positioned adjacent to the dash front surface and a distal end 34 at the opposite end of the handle 20 and spaced from the base. In addition, the handle 20 includes first and second major opposed surfaces 36, 38 (surface 38 being shown in FIG. 4) and respective side edges 40, 42.

The major surfaces 36, 38 have recessed regions proximate to the distal end of the handle 20. As best seen in FIG.

4, the recessed areas 44, 46 are of a concave configuration and contribute to the desired flexibility of the handle upon impact. The distal end 34 is rounded both at its corners and the side edges 40, 42 are also rounded to eliminate sharp surfaces which may be impacted by a truck operator or passenger. In its overall configuration, as best shown in FIG. 3, the preferred form of handle 20 is generally rectangular and of a spatulate shape.

The handle 20 is preferably comprised of a resilient flexible material so as to absorb shock upon impact, for example by an operator or passenger of a vehicle during a collision. To provide a good feel for the switch during normal operation while yet providing shock absorbing characteristics in the event of impact, the handle 20 preferably has a stiffness in bending or springback within a desired range. In this case, although some variability is permitted, the handle 20 is most preferably designed to have a stiffness in bending in response to a force applied to the distal end 34 of the handle in a direction perpendicular to the major opposed surfaces and to the longitudinal axis of from twenty-five pounds to thirty pounds per inch at seventy-five degrees Fahrenheit. Most preferably, the handle has a stiffness in bending in response to a force applied in this manner of twenty-eight pounds per inch at seventy-five degrees Fahrenheit. It is helpful to specify the stiffness of the handle at seventy-five degrees Fahrenheit since that is essentially a standard comfortable temperature, or "shirt sleeve" environment, typical of a truck cab during operation. Thus, at about this temperature, the handle would be soft enough to reduce the chance of impact injury and stiff enough to give a solid feel during operation. Generally, elastomeric material gets softer with increasing temperatures and harder with decreasing or colder temperatures.

The concave nature of the major opposed surfaces 36, 38 of the handle contribute to the flexibility of the handle and thus to its bendability in response to such forces. The concave major opposed surfaces create a thinned region of material in the center portion of handle 20 which in effect behaves as a resistive hinge about which the handle bends in response to forces applied in this manner.

Most preferably the handle 20 is of an elastomeric material. One specific preferred material is elastomeric material of a durometer from 75–95 on the Shore A scale measured at seventy-three degrees Fahrenheit with a specifically preferred material being elastomeric material of a durometer of about 85 on the Shore A scale measured at this temperature. Other materials and configurations having the desired stiffness in bending set forth above may also be used and thus the handle need not be made of elastomeric material. A specifically preferred material is Santoprene thermoplastic elastomer of a durometer of 85 on the Shore A scale at this temperature.

The toggle switch 12 of FIG. 3 has a housing 50 within which the contacts and other components of the switch are positioned. A plurality of spade lugs 52, one being numbered in FIG. 3, may be utilized to make electrical connection between the components within the toggle switch and electrical circuits coupled thereto.

The present invention is not directed toward the specific components of the toggle switch 12 as the handle 20 of the present invention may be utilized in toggle switches of other configurations. However, to describe one toggle switch environment in which the toggle switch handle 20 of the present invention may be used, reference should be made to FIGS. 4 and 5. The toggle switch environment, apart from the handle 20, is an Eaton Corporation designed toggle switch.

Figure 4:
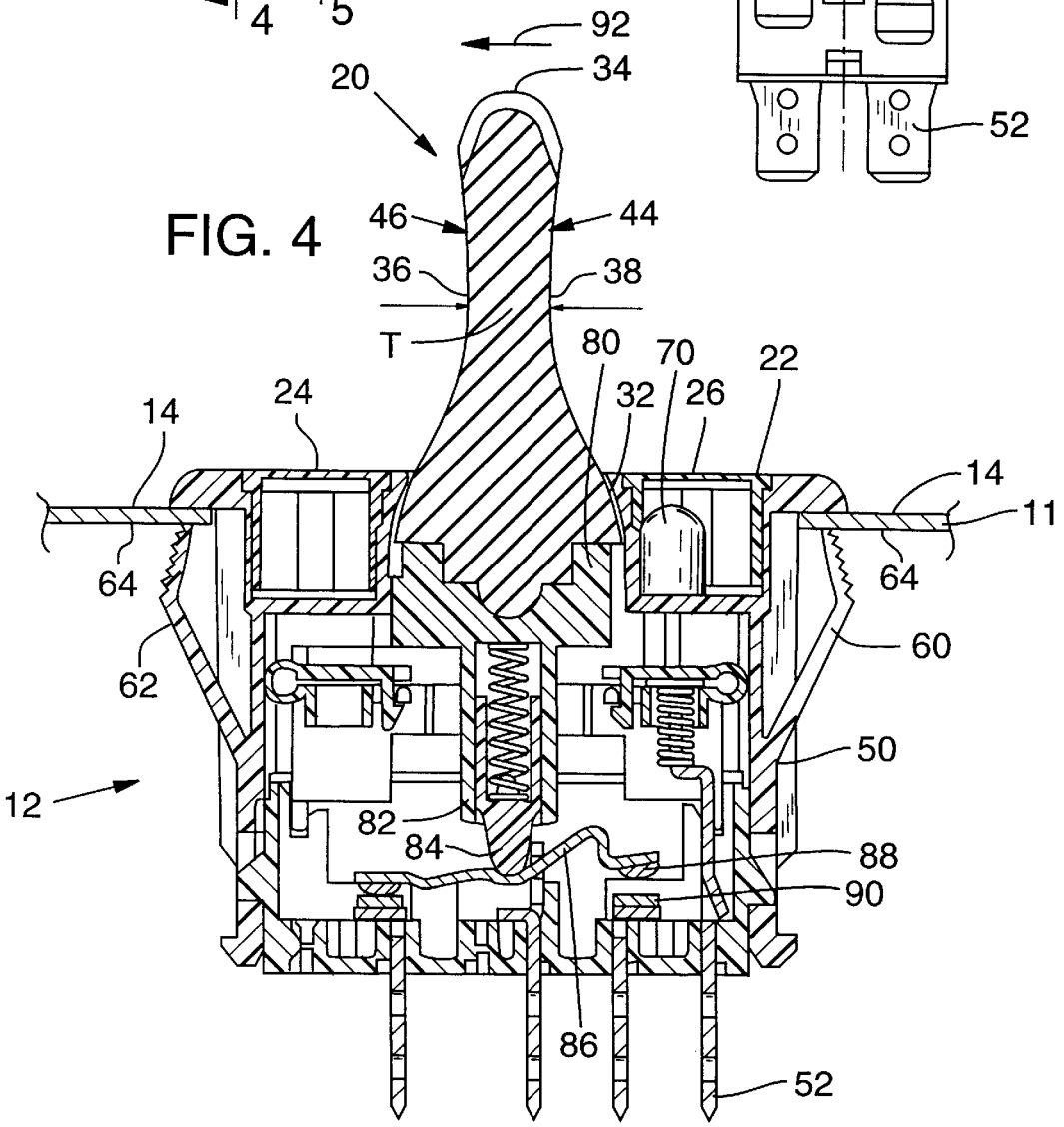
FIG. 4 is a cross-sectional view of the toggle switch which includes a handle of the present invention, taken along line 4—4 of FIG. 2.
Figure 5:
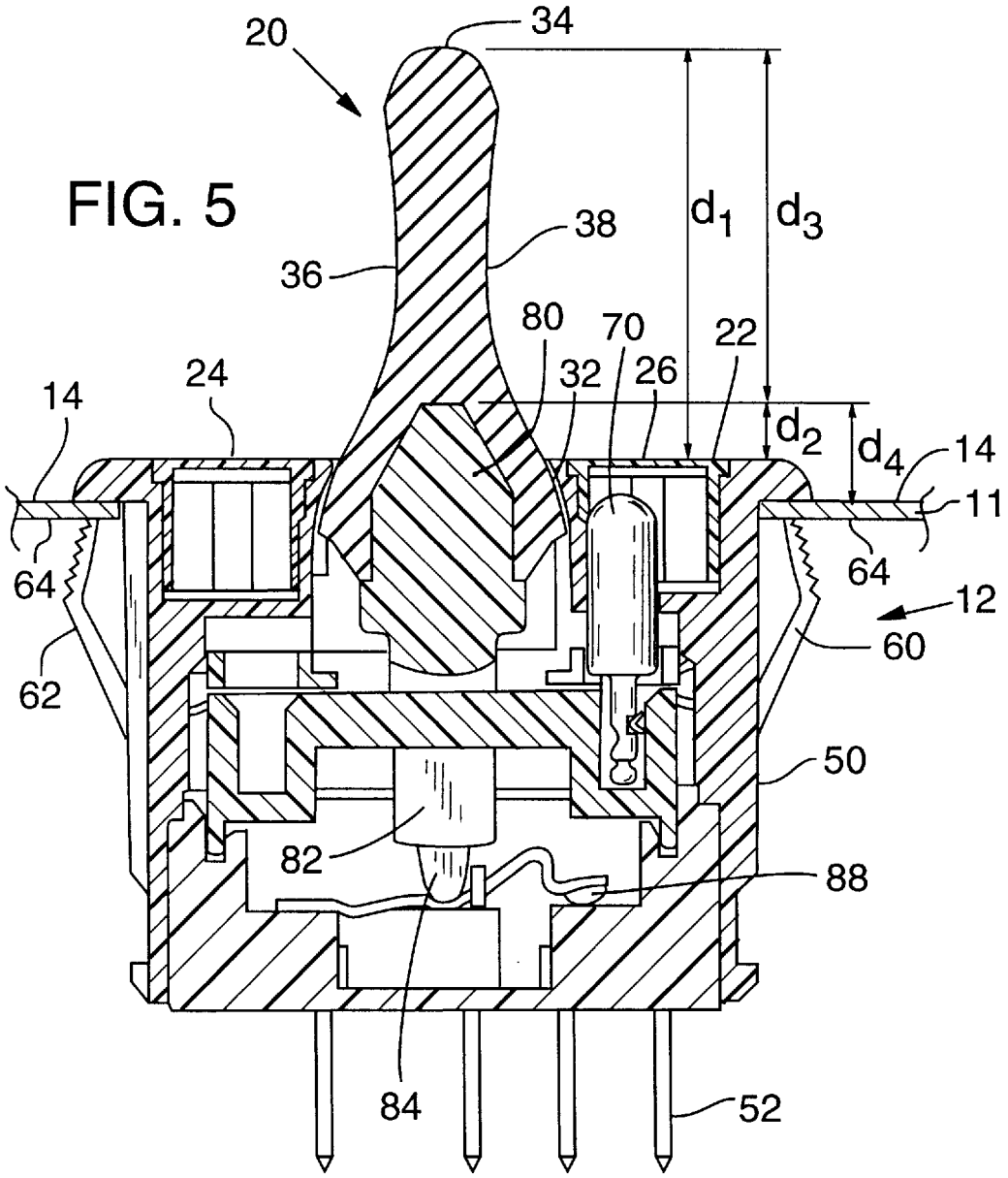
FIG. 5 is a cross-sectional view, taken along line 5—5 of FIG. 2, of a toggle switch with a handle in accordance with the present invention.

The illustrated toggle switch 12 in FIGS. 4 and 5 includes a pair of gripping legs 60, 62 projecting outwardly from the end walls of housing 50 in a position to grip the underside 64 of the truck dash 11. The dash 11 is effectively wedged between the gripping element 60, 62 and the underside of a deck 22 of the toggle switch 12. An incandescent bulb is positioned under each of the indicia plates 26, 24 with one such bulb being indicated at 70 in FIG. 4. These bulbs are coupled by electrical contacts to a source of power when desired to illuminate the indicia. An LED may be used in lieu of indicia plates with incandescent bulbs.

Figure 8:
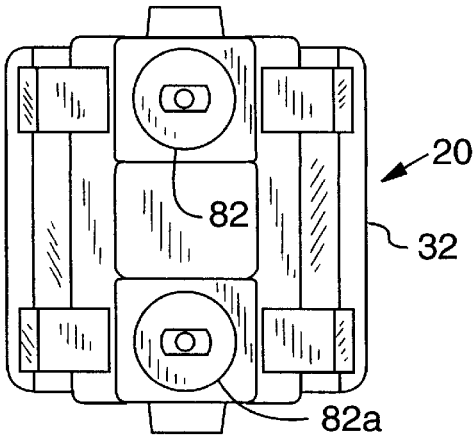
FIG. 8 is a bottom view of the toggle switch handle and lever of FIG. 6.

A switch actuating lever 80 is coupled to the bottom of the base 32. The base 32 is enlarged to accommodate the upper end of the lever 80. In this example, lever 80 includes a pair of downwardly projecting tubes defining annular flanges 82, 82a (the flange 82*a* being best shown in FIGS. 6 and 8) within which respective spring-biased plungers 84 are positioned. Plunger 84 rests against a movable contact making lever arm 86. The arm 86 is shown in FIG. 4 in the open position with its contact 88 spaced from a contact 90 of the switch. If toggle handle 20 is moved to the left in FIG. 4, the plunger 84 travels along a ramp defined by arm 86 (to the right in FIG. 4) causing contact 88 to close against contact 90 and the completion of an electrical circuit controlled by the toggle switch.

As can be seen in FIG. 5, the lever 80, which is typically of plastic or some other material which is stiffer than the handle 20, extends into the bottom of the handle base 32. In addition, the base 32 surrounds the upper portion of the lever. By limiting the extent to which the lever 80 projects into the base along the longitudinal axis of the handle 20, the impact of lever 80 on the resilience and bendability of the handle is minimized. That is, the handle is still free to flex upon impact, with virtually no interference by the lever 80, to a bent position (e.g. with the handle moved toward the front surface of the dash 14).

With reference to FIG. 5, the distance $d_1$, is defined as the distance from the upper surface of toggle switch platform or deck 22 to the distal end 34 of the handle 20. In addition, the distance $d_2$ is defined as the distance from the upper end of lever 80 to the deck 22. Furthermore, the distance $d_3$ is defined as the distance from the upper end of the lever 80 to the distal end of handle 34. In addition, the distance $d_4$ is defined as the distance from the upper end of the lever 80 to the 5 upper surface 14 of the dash. In the illustrated preferred embodiment, the distance d4 along the longitudinal axis of the handle 20 is preferably no more than one-third of the sum of the distances $d_3$ and $d_4$, the sum being the distance which the handle projects 10 outwardly from the surface 14 of the dash when the handle 20 is projecting furtherest from the dash surface 14. Most preferably, the distance $d_4$ is no more than one-fourth, and preferably less than one-fourth, of the sum of the distances $d_3$ and $d_4$. Again, by utilizing a 15 lever 80 which extends only a short distance into the handle 20, the major portion of the handle may consist essentially of the material of the above described resiliency, such as an elastomeric material. As a result, the lever 80 does not significantly interfere 20 with the desired bendability of the handle 20 upon impact.

Figure 6:
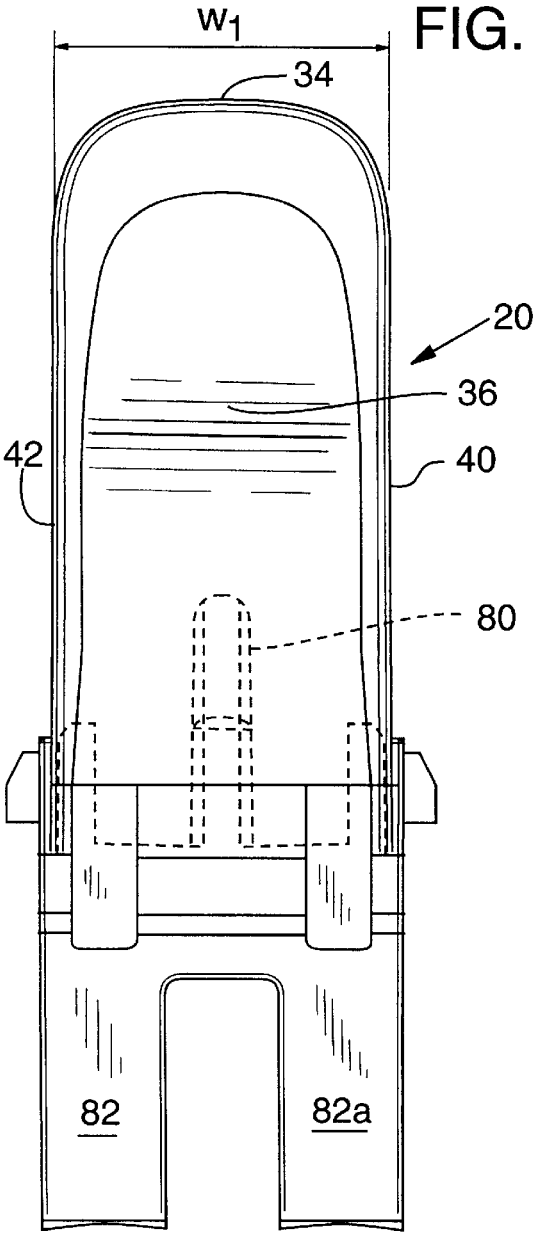
FIG. 6 is a front view showing one major surface of a toggle switch handle in accordance with the present invention and also showing an actuating lever coupled thereto.
Figure 7:
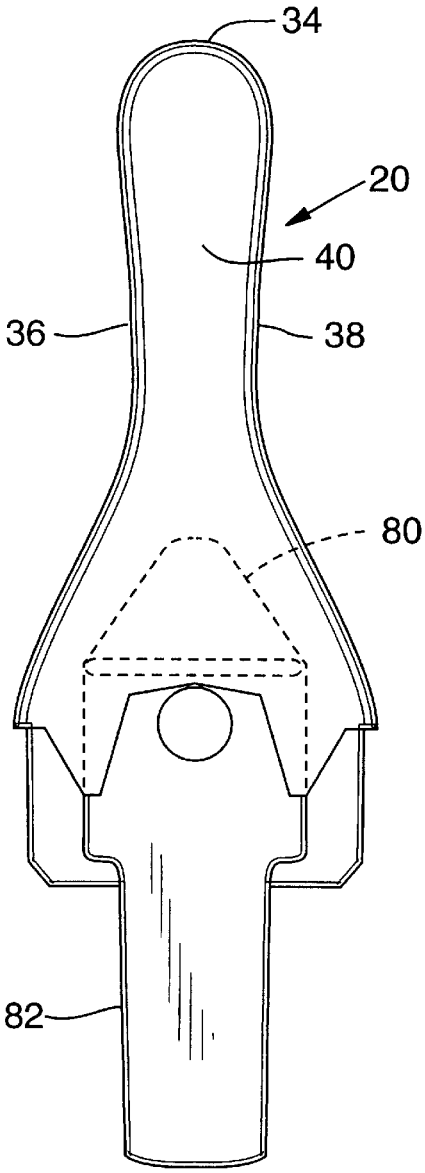
FIG. 7 is a side view of the toggle switch handle and lever of FIG. 6.

Although the dimensions may be varied, in a specifically preferred embodiment of the present invention, the distance $d_1$, is 28.6 millimeters (mm), the 25 distance $d_2$ is 6.1 mm, the distance $d_3$ is 22.1 mm, and the distance $d_4$ is 8.6 mm. In addition, the thickness T (FIG. 4) in this specifically preferred embodiment between opposed major surfaces 36, 38 at the thinnest portion of the handle 20 is 3.9 mm, and is 5.9 mm 30 between the edges 40, 42. With reference to FIGS. 6 and 7, this specifically preferred embodiment of the present invention, the width $W_1$ of the handle 20 is 16.1 mm.

Having illustrated and described the principles of our invention with reference to a preferred embodiment, it should be apparent to those of ordinary skill in the art that the invention may be modified in arrangement and detail without departing from such principles. It should specifically be understood that the toggle switch handle of the present invention with the specified bendability may be utilized with toggle switch components, including and actuating lever, of a different design from that shown above. We claim as our invention all such modifications as fall within the scope of the following claims.

I claim:

1. In a truck dash having a front surface, at least one electrical toggle switch having a switch handle with a longitudinal axis and which projects 5 outwardly from the front dash surface, the handle having a base positioned adjacent to the front-surface and a distal end spaced from the base, the handle comprising a resilient flexible material, the handle having a stiffness in bending in response to a force applied at the distal end and in a direction perpendicularly to the longitudinal axis of from twenty-five pounds to thirty pounds per inch at seventy-five degrees Fahrenheit.

2. An electrical toggle switch according to claim 1 in which the handle has a stiffness in bending in response to a force applied perpendicularly to the longitudinal axis of twenty-eight pounds per inch at seventy-five degrees Fahrenheit.

3. An electrical toggle switch according to claim 1 in which the handle is of an elastomeric material.

4. An electrical toggle switch according to claim 1 in which the handle is of a spatulate shape with opposed major surfaces and has first and second side edges, the major surfaces having recessed regions proximate to the distal end, and wherein the distal end and first and second side edges are rounded.

5. A truck dash having at least one toggle switch according to claim 1 wherein the handle consists essentially of an elastomeric material of a durometer of from 85 to 95 on the Shore A scale measured at seventy-three degrees Fahrenheit.

6. A truck dash having at least one toggle switch according to claim 5 wherein the handle consists essentially of an elastomeric material of a durometer of about 90 on the Shore A scale measured at seventy-three degrees Fahrenheit.

7. A truck dash having a front surface and at least one electrical toggle switch having an elongated switch handle with a longitudinal axis, the switch handle projecting from the dash front surface and extending a first distance measured along the longitudinal axis of the switch handle, the switch handle consisting essentially of a resilient flexible material which bends and absorbs shock upon impact, the toggle switch including a lever coupled to and actuated by the handle, the lever extending into the handle no more than one-third of the first distance, whereby the toggle switch handle flexes and absorbs shock upon impact by a driver or passenger in the trucks and wherein the lever and flexible material abut one another without a void between the lever and flexible material.

8. A truck dash having at least one toggle switch according to claim 7 in which the lever extends into the handle no more than one-fourth of the first distance.

9. A truck dash having at least one toggle switch according to claim 7 in which the handle has a base positioned adjacent to the dash front surface and a distal end spaced from the base, the handle having a stiffness in bending in response to a force applied at the distal end and in a direction perpendicular to the longitudinal axis of from twenty-five pounds to thirty pounds per inch at seventy-five degrees Fahrenheit.

10. A truck dash having at least one toggle switch according to claim 9 in which the handle is of a spatulate shape with opposed major surfaces, and wherein the handle has first and second side edges, the major surfaces having recessed regions proximate to the distal end and wherein the distal end and first and second side edges are rounded.

11. A truck dash having at least one toggle switch according to claim 7 in which the handle is of a spatulate shape with opposed major surfaces, and wherein the handle has first and second side edges, the major surfaces having recessed regions proximate to the distal end, and wherein the distal end and first and second side edges are rounded.

12. A toggle switch handle for a toggle switch for mounting to a front surface of a truck dash, the handle comprising an elongated body with a longitudinal axis and projecting outwardly from the front dash surface when the toggle switch is mounted in place, the handle having a base at the front dash surface inot which a toggle switch lever may be inserted to extend no more than one-third the distance along the longitudinal axis, the portion of the handle projecting outwardly beyond the dash front surface and beyond the lever being comprised of a resilient flexible material which bends and absorbs shock upon impact by a driver or passenger in the truck and the handle having a distal end spaced from the dash front surface and the base, the handle comprising a spatulate blade having major opposed surfaces with recesses in the major opposed surfaces and which are proximate to the distal end, the distal end having curved surfaces.

13. A toggle switch handle for a toggle switch for mounting to a front surface of a truck dash, the handle comprising an elongated body with a longitudinal axis and projecting outwardly from the front dash surface when the toggle switch is mounted in place, the handle having a base at the front dash surface into which a toggle switch lever may be inserted to extend no more than one-third the distance along the longitudinal axis, the portion of the handle protecting outwardly beyond the dash front surface and beyond the lever being comprised of a resilient flexible material which bends and absorbs shock upon impact by a driver or passenger in the truck; and wherein the handle consists essentially of an elastomeric material of a durometer of from 85 to 95 on the Shore A scale measured at seventy-three degrees Fahrenheit.

14. A toggle switch handle for a toggle switch for mounting to a front surface of a truck dash, the handle comprising an elongated body with a longitudinal axis and projecting outwardly from the front dash surface when the toaale switch is mounted in place, the handle having a base at the front dash surface into which a toggle switch lever may be inserted to extend no more than one-third the distance along the longitudinal axis, the portion of the handle projecting outwardly beyond the dash front surface and beyond the lever being comprised of a resilient flexible material which bends and absorbs shock upon impact by a driver or passenger in the truck; and in which the handle has a stiffness in bending in response to a force applied at the distal end and in a direction perpendicular to the longitudinal axis of from twenty-five pounds to thirty pounds per inch at seventy-five degrees Fahrenheit.

15. A toggle switch for mounting to a front surface of a truck dash, the toggle switch having a handle comprising an elongated body with a longitudinal axis and projecting outwardly from the front dash surface when the toggle switch is mounted in place, the handle having a base at the front dash surface into which a toggle switch lever may be inserted, the portion of the handle projecting outwardly beyond the dash front surface and beyond the lever being comprised of a resilient flexible material which bends and absorbs shock upon impact by a driver or passenger in the truck; and in which the toggle switch is enclosed in a housing having a platform with an outer surface, the handle projecting outwardly beyond the outer surface of the platform, and at least a portion of the resilient flexible material forming the handle being positioned within the housing and below the outer surface.

* * * * *

UNITED STATES PATENT AND TRADEMARK OFFICE

CERTIFICATE OF CORRECTION

PATENT NO. : 5,769,209
DATED : June 23, 1998
INVENTOR(S) : William G. Massey III It is certified that error appears in the above-identified patent and that said Letters Patent is hereby corrected as shown below:

Column 4,
Line 45, “to the 5 upper” should read -- to the upper --.
Line 49, “project 10 outwardly” should read -- project outwardly --.
Line 53, “a 15 lever” should read -- a lever --.
Line 58, “interfere 20 with” should read -- interfere with --.
Line 62, “$d_1$, is” should read -- $d_1$ is --.
Line 62, “the 25 distance” should read -- the distance --.
Line 67, “5.9 mm 30 between” should read -- 5.9 mm between --.

Column 5,
Line 17, “projects 5 outwardly” should read -- projects outwardly --.
Line 57, “trucks and” should be -- trucks, and --

Column 6,
Line 21, “surface inot which” should be -- surface into which --
Line 51, “toaale switch” should be -- toggle switch --

Signed and Sealed this

Tenth Day of June, 2003

JAMES E. ROGAN
*Director of the United States Patent and Trademark Office*